US006916275B2

(12) United States Patent
Beedy

(10) Patent No.: US 6,916,275 B2
(45) Date of Patent: Jul. 12, 2005

(54) MUSCLE STRENGTHENING BAR

(76) Inventor: Rocky K. Beedy, 3571 Oasis Rd., Redding, CA (US) 96003

( * ) Notice: Subject to any disclaimer, the term of this patent is extended or adjusted under 35 U.S.C. 154(b) by 437 days.

(21) Appl. No.: 10/281,132

(22) Filed: Oct. 28, 2002

(65) Prior Publication Data

US 2004/0082442 A1 Apr. 29, 2004

(51) Int. Cl.[7] ..... A63B 21/06; A63B 23/14
(52) U.S. Cl. ..... 482/46; 482/50; 482/99
(58) Field of Search ..... 482/44–46, 49, 482/50, 93, 94, 98, 99, 105–109, 139, 904; D21/684, 680; 294/153, 158, 167, 168

(56) References Cited

U.S. PATENT DOCUMENTS

| | | | | | |
|---|---|---|---|---|---|
| 3,263,432 | A | * | 8/1966 | Maskell | 405/186 |
| 3,752,525 | A | * | 8/1973 | Hanna et al. | 294/74 |
| 4,438,920 | A | | 3/1984 | Veillette | |
| 5,060,933 | A | | 10/1991 | Cedro | |
| 5,312,309 | A | * | 5/1994 | Fox | 482/45 |
| 5,547,441 | A | * | 8/1996 | Mora | 482/46 |
| 5,807,214 | A | * | 9/1998 | Riazi | 482/129 |
| 5,857,949 | A | * | 1/1999 | Tebbe et al. | 482/140 |
| 6,099,437 | A | | 8/2000 | DeMers | |
| 6,234,934 | B1 | * | 5/2001 | Gorczyca | 482/50 |
| 6,312,359 | B1 | | 11/2001 | Brundle | |
| 2002/0137599 | A1 | * | 9/2002 | Kuo | 482/93 |
| 2003/0220174 | A1 | * | 11/2003 | Lear | 482/93 |

FOREIGN PATENT DOCUMENTS

| | | | | |
|---|---|---|---|---|
| DE | 830916 | | 2/1952 | |
| GB | 2277041 | A * | 10/1994 | A63B/23/14 |

* cited by examiner

*Primary Examiner*—Jerome W. Donnelly
*Assistant Examiner*—Victor K. Hwang
(74) *Attorney, Agent, or Firm*—Richard C. Litman

(57) ABSTRACT

A muscle strengthening bar for the shoulders, arms, hands and wrist that includes a roll-up bar, a weight support by a plate on the end of a strap and a pair of handles on the roll-up bar. The user, by extending out the arms, can raise and lower the weight on the strap by rolling the handles attached to the roll-up bar. The rolling action of hands on the handles causes tension on the strap which is attached to the plate which supports the weight.

8 Claims, 3 Drawing Sheets

MUSCLE STRENGTHENING BAR

BACKGROUND OF THE INVENTION

1. Field of the Invention

The present invention relates to exercise devices and more particularly to exercise equipment that strengthens the wrists, arms and shoulders.

2. Description of the Related Art

Various exercise devices have been created for strengthening forearms, wrists and shoulders. By strengthening these muscle groups, one can increase the power of one's grip. U.S. Pat. No. 4,438,920 discloses an exercise device for the hands and wrists that has a cylindrical body attached to a flexible cord which has a T-shaped holder for the weight. U.S. Pat. No. 5,060,933 shows a wrist stick that allows the uses to perform different exercises which includes ones for the wrists and arms. U.S. Pat. No. 6,099,437 describes an exercise apparatus that has elongated body attached to a lanyard which holds the weight. U.S. Pat. No. 6,312,359, issued Nov. 6, 2001 to R. P. Brundle, shows an exercise apparatus having a weight suspended from a bar by a cord. German patent 830,916 shows a exercise devise with an elongated member that has flexible cord which is attached to a weight holder and a series of weights.

None of the above inventions and patents, taken either singly or in combination, is seen to describe the instant invention as claimed. Thus a muscle strengthening bar solving the aforementioned problems is desired.

SUMMARY OF THE INVENTION

The present invention is a muscle strengthening bar for the shoulders, arms, hands and wrist that includes a roll-up bar, a weight supported by a plate on the end of a strap, and a pair of handles on the roll-up bar. The user, by extending out the arms, can raise and lower the weight on the strap by rolling the handles attached to the roll-up bar. The rolling action of hands on the handles causes tension on the strap which is attached to the plate which supports the weight.

Accordingly, it is a principal object of the invention to provide an exercise device that is easy to use, easy to store and can be carried with the user.

It is another object of the invention to provide an exercise device that can be used by athletes, persons in wheelchairs and seniors to strengthen muscles and improve their grip.

It is a further object of the invention to provide an exercise device that is useful for therapy for carpal tunnel syndrome.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
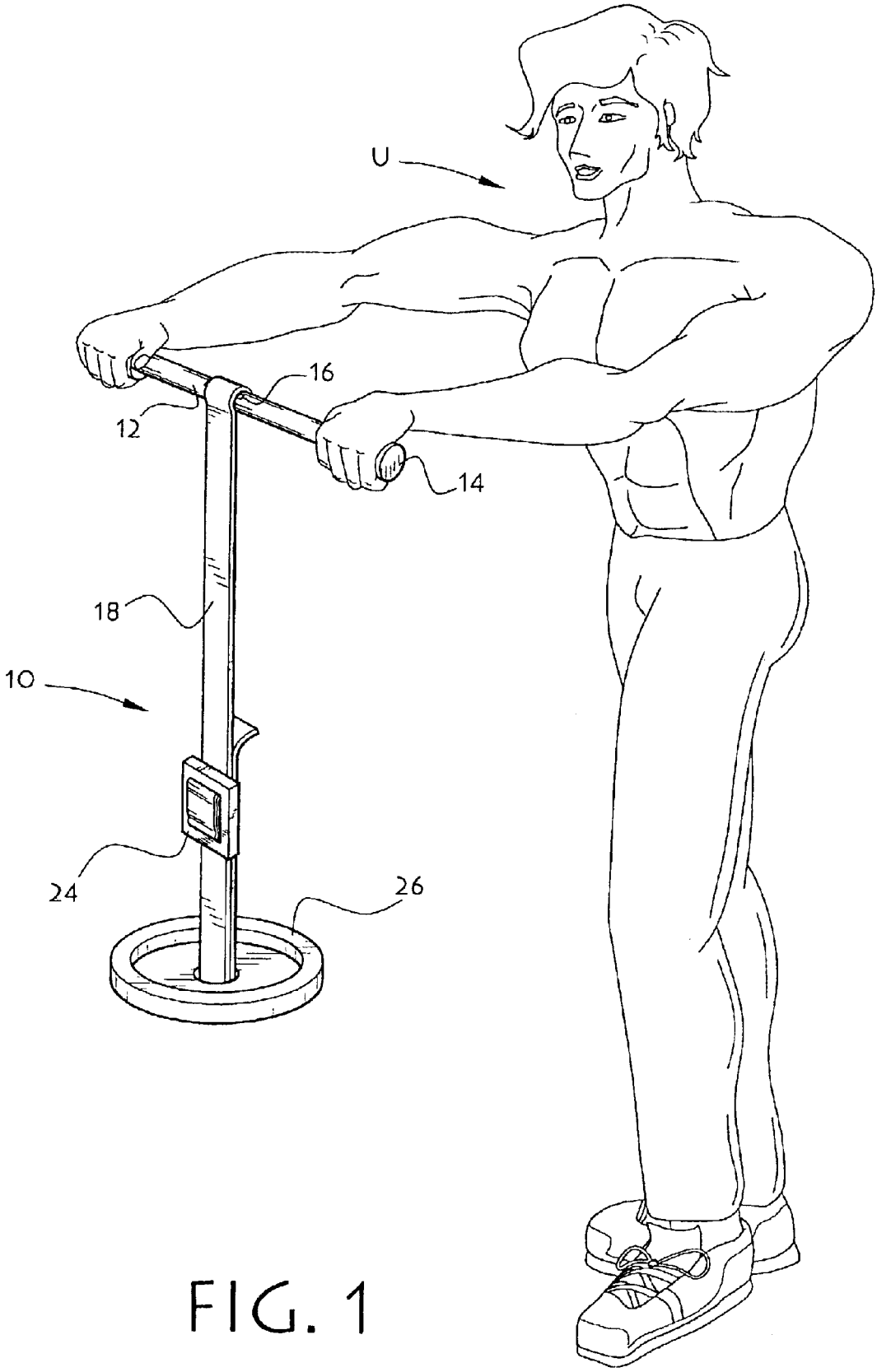
FIG. 1 is an environmental, perspective view of a muscle strengthening bar according to the present invention.
Figure 3:
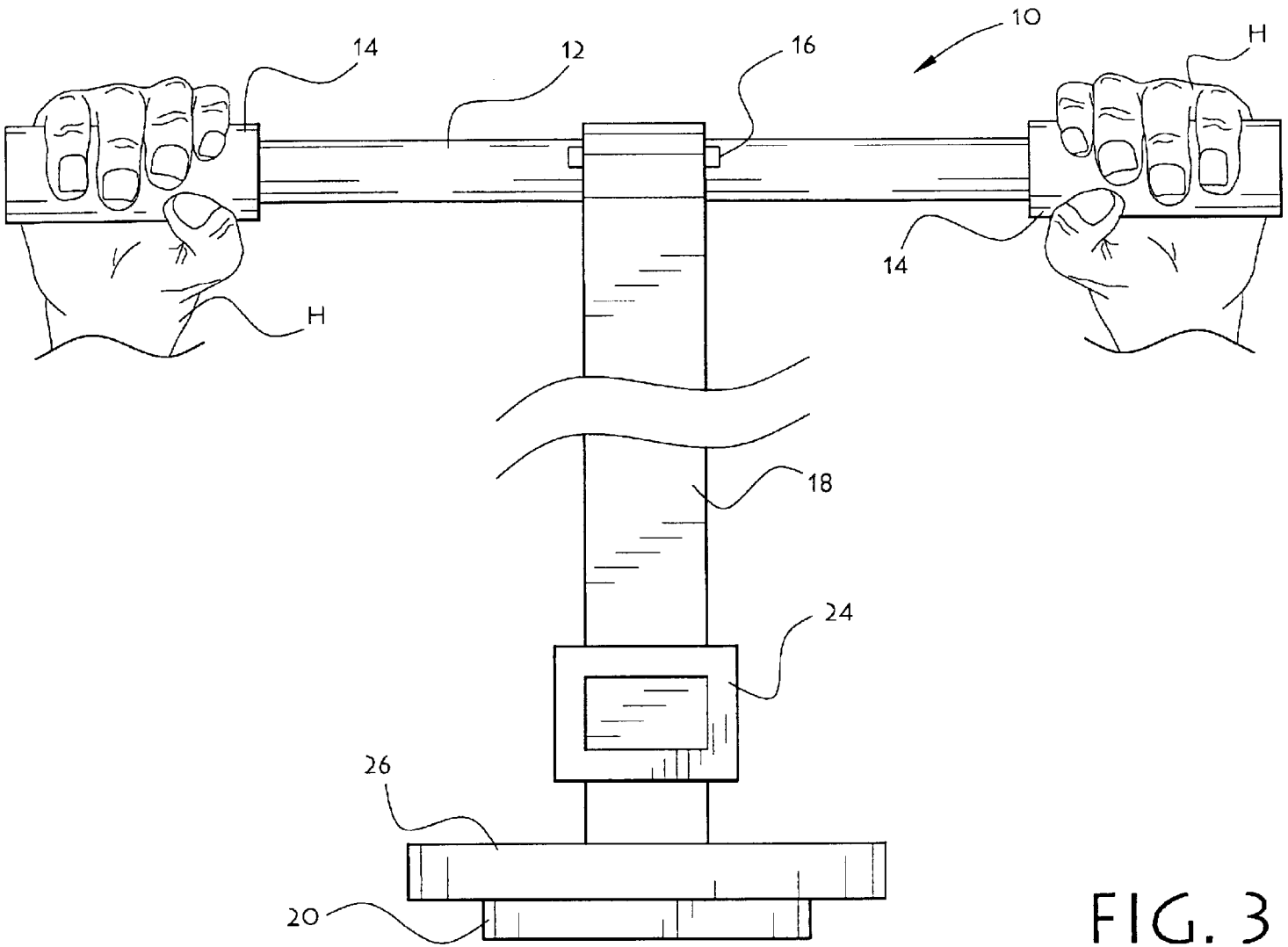
FIG. 3 is an environmental front elevational view of the muscle strengthening bar.

The present invention, a muscle strengthening bar 10, is shown in FIGS. 1 and 3 being held by the user U. The user U places his/her hands H onto the roll up bar 12 using the grips 14. This allows the user U to apply a tension to the strap 18, which extends through a slot 16 defined in the bar 12. The strap 18 supports an annular weight 26 which is supported by a plate 20 (as shown in FIG. 3). A clip 24 holds the end of the strap 18 and the plate 20 in position. The user U then raises or lowers the weight 26 by rolling the grips 14 attached to the roll up bar 12 which winds or unwinds the strap 18 around the roll up bar 12.

Figure 2:
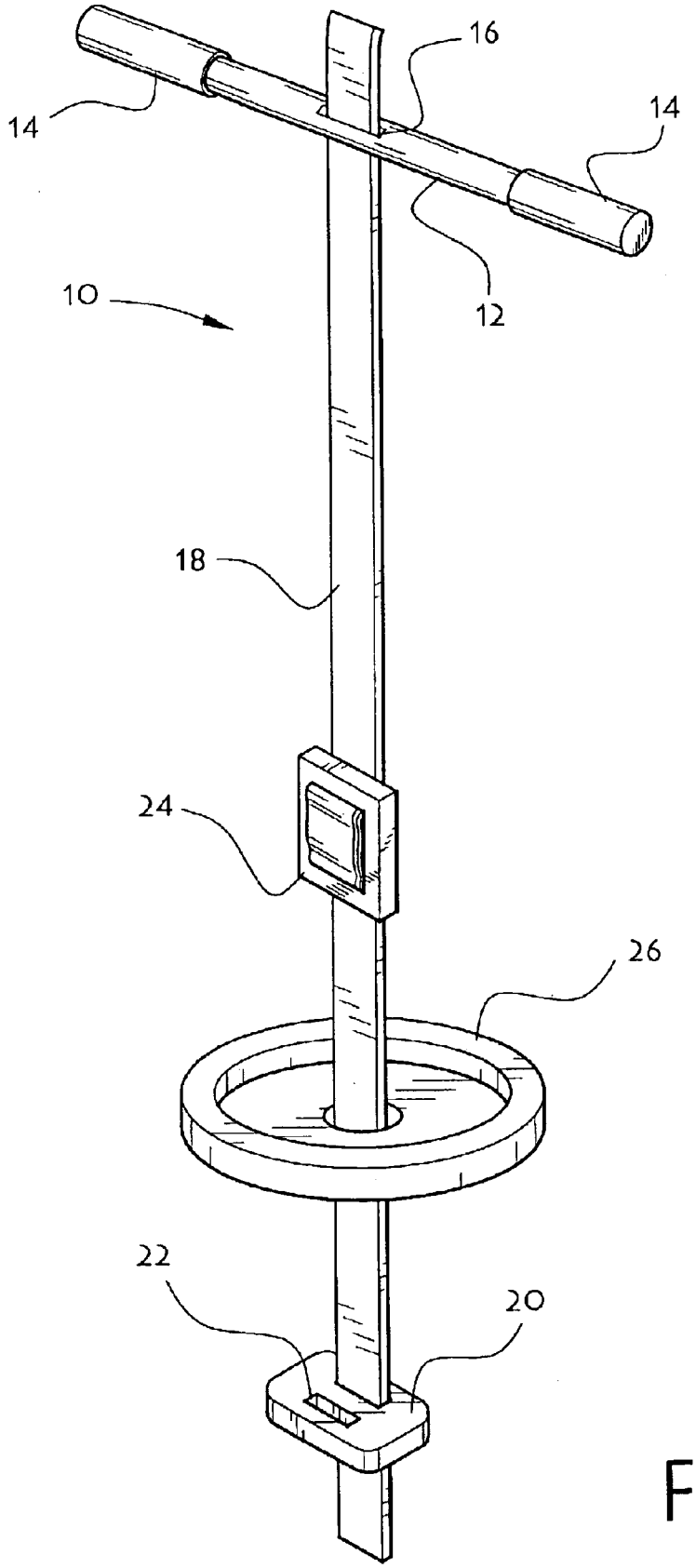
FIG. 2 is an isometric view of the muscle strengthening bar.

FIG. 2 shows the muscle strengthening bar 10 comprising a roll up bar 12 having grips 14 attached to the ends. The roll up bar 12 can be solid or hollow. Metal, wood or plastic can be use to construct the roll up bar 12. The roll up bar 12 has a slot 16 that extends through to allow one end of a strap 18 to be inserted. It should be noted that the strap 18 is not fixed to the bar 12, but is simply held by friction as the strap 18 is rolled around the bar 12. The strap 18 is a nylon strap, but any type of material can be utilized. The user U can adjust the length of the strap 18 simply by how much strap 18 is placed through the slot 16. The other end of the strap 18 is inserted through the slots 22 of a plastic plate 20. The plate 20 could be metal. The strap 18 is held in place by a plastic clip 24. The clip 24 could be metal. The clip 24 allows the user U to take the muscle strengthening bar 10 apart easily for storing and transporting.

It will be noted that the clip 24 is narrower in width than the diameter of the hole through the weight 26 so that the weight 26 simply slides past the clip 24 and is supported only by the plate 20. This enables the user U to change weights quickly and easily. The clip 24 also aids in holding the plate 20 in place when the weight 26 is added. More weight can be added by simply removing the strap 18 from the slot 16 in the roll up bar 12, adding the amount of weight desired, reinserting the end of the strap 18 into the slot 16 of the roll up bar 12, and the muscle strengthening bar 10 is again ready for use.

It is to be understood that the present invention is not limited to the embodiments described above, but encompasses any and all embodiments within the scope of the following claims.

I claim:

1. A muscle strengthening bar, comprising:

an elongated roll up bar having opposing ends and having a slot extending through said roll up bar;

a pair of hand grips disposed on the opposing ends of said roll up bar;

an elongated flexible strap having a first end, a second end, and a body extending between the first and second ends, the first end of said strap being slidable through the slot defined in said roll up bar;

a plate having two parallel slots, the second end of said strap being inserted through the parallel slots in order to double back parallel to the body of said strap; and a clip attaching the second end to the body of said strap in order to secure said plate adjacent the second end of said strap;

whereby an annular weight is adapted for insertion over the first end of said strap and the clip in order to be supported by said plate, the first end of said strap being inserted through the slot in said roll up bar, said strap being rolled and unrolled on said roll up bar for strengthening muscles.

2. The muscle strengthening bar according to claim 1, wherein the elongated roll up bar is solid.

3. The muscle strengthening bar according to claim 1, wherein the elongated roll up bar is metal.

4. The muscle strengthening bar according to claim 1, wherein the strap is a nylon strap.

5. The muscle strengthening bar according to claim 1, wherein the plate is plastic.

6. The muscle strengthening bar according to claim 1, wherein the clip is plastic.

7. The muscle strengthening bar according to claim 1, wherein the elongated roll up bar is hollow.

8. The muscle strengthening bar according to claim 1, further comprising an annular weight disposed on said strap.

* * * * *